United States Patent [19]

Kubo et al.

[11] Patent Number: 4,826,412

[45] Date of Patent: May 2, 1989

[54] MECHANICALLY DRIVEN SCREW SUPERCHARGER

[75] Inventors: Kazuo Kubo, Kobe; Itsuro Nomura, Takarazuka; Kunihiko Nishitani, Akashi; Noboru Tsuboi, Kakogawa, all of Japan

[73] Assignee: Kabushiki Kaisha Kobe Seiko Sho, Kobe, Japan

[21] Appl. No.: 141,419

[22] Filed: Jan. 7, 1988

[30] Foreign Application Priority Data

May 1, 1987 [JP] Japan ..... 62-109244
May 14, 1987 [JP] Japan ..... 62-119518

[51] Int. Cl.[4] ..... F02B 33/36; F04C 29/08

[52] U.S. Cl. ..... 418/180; 418/201; 123/564

[58] Field of Search ..... 123/559.1, 564; 418/15, 418/180, 201

[56] References Cited

U.S. PATENT DOCUMENTS 1,542,614 6/1925 Ellis ..... 418/201 X
2,519,913 8/1950 Lysholm ..... 418/180 X
4,551,081 11/1985 Sato et al. ..... 418/55
4,594,992 6/1986 Nakamura et al. ..... 123/559.1

*Primary Examiner*—Michael Koczo
*Attorney, Agent, or Firm*—Oblon, Fisher, Spivak, McClelland & Maier

[57] ABSTRACT

A screw supercharger is provided having a set of male and female screw rotors rotatably supported in a casing and driven through a wrapping transmission including belts and pulleys by a prime mover, wherein a through hole is formed in the wall of the causing at a position through which the input shaft of the screw rotor or the extension of the axis of the input shaft of the screw rotor extends, in that a cylindrical bearing supporting part is formed around the through hole so as to project outside from the casing, and in that a driven pulley is supported through bearings on the bearing supporting part and is fixedly mounted on the input shaft.

3 Claims, 5 Drawing Sheets

MECHANICALLY DRIVEN SCREW SUPERCHARGER

BACKGROUND OF THE INVENTION

1. Field of the Invention

The present invention relates to a supercharger and, more specifically, to a mechanically driven screw supercharger for supercharging internal-combustion engines such as automotive engines, marine engines and industrial engines.

2. Description of the Prior Art

Japanese Patent Provisional Publication (Kokai) No. 51-37316 discloses a mechanically driven screw supercharger 10 shown in FIG. 6.

The mechanically driven screw supercharger 10 has a set of male and female screw rotors 3 and 4 which are driven for rotation through a driving pulley 5, a belt 6 and a driven pulley 7 by a crankshaft 2 to such air through a suction filter 8 and to supercharge an internal-combustion engine (hereinafter referred to simply as "engine") 1. The screw supercharger 10 employing the screw rotors 3 and 4 is of a displacement type, and the rotating speed of the screw rotors 3 and 4 is proportional to the rotating speed of the crankshaft 2 of the engine 1. Therefore, the screw supercharger 10 has an advantage in that the engine 1 can be supercharged at the start and during acceleration without any time lag, which is impossible when using an exhaust turbine supercharger (turbo supercharger) driven by the exhaust gas.

Furthermore, having an internal compressing mechanism, the screw supercharger 10 operates at a lower compression loss and at a higher adiabatic efficiency as compared with the mechanically driven Roots supercharger.

FIG. 7 shows a conventional screw compressor applicable to the supercharger for the aforesaid application. This screw compressor is provided with a set of meshing female and male screw rotors (hereinafter referred to simply as "rotors") 3 and 4 rotatably supported in a casing 9. The rotative power of a prime mover 101 is transmitted through a driving pulley 5, belts 6 and a driven pulley 7 to the rotors 3 and 4. The driven pulley 7 is mounted fixedly on an input shaft 35, i.e., the rotor shaft of the female rotor 4, projecting outside through the casing 9. In this compressor employing the pulleys 5 and 7 and the belts 6 for transmitting the rotative power of the prime mover 101 to the rotors 3 and 4, the power is transmitted through the frictional engagement of the belts 6 and the pulleys 5 and 7. Therefore, a considerably high tension is applied to the belts 6 to produce a frictional force of a necessary magnitude between the belts 6 and the pulley 5 and 7. Accordingly, the input shaft 13 is subjected to a bending stress applied thereto by the belts 6 in addition to a torsional stress, and hence the input shaft 13 must have a considerably large diameter to withstand such stresses. However, an increase in the size of the rotor shaft, and hence the size of the bearings, entails an increase in the size and weight of the compressor, an increase in mechanical power loss attributable to the use of large bearings, and a lowering of the upper limit of the rotating speed of the rotors.

Furthermore, in the compressor of an oil-free type having synchronizing gears 11 and 12 as shown in FIG. 7, the bending of the input shaft 13 spoils the setting of the compressor and is liable to cause the rotors 3, 4 to interfere with each other. Still further, it is difficult to combine this known screw compressor with an engine to use the same as a supercharger, because this screw compressor is intended for use as a compressor and not as a supercharger and, when used as a supercharger, the characteristics of the screw compressor need to match those of the engine.

As is obvious from the air demand characteristics of an engine 1 as shown in FIG. 8, air demand Q2 per combustion cycle, namely, the quantity of air to be sucked into the combustion chamber for one combustion cycle to maintain the output torque of the engine 1 at a fixed level, is substantially constant regardless of the engine speed, and hence air demand Q1 per unit time, namely, the quantity of air to be supplied into the combustion chamber per unit time, increases in proportion to the engine speed. However, supercharging pressure needs to be increased with engine speed to maintain the air demand Q2 per unit time, because rheological resistance and the resistance of the suction valve against the flow of air increase with engine speed.

The supercharger 10 has the above-mentioned excellent characteristics, while the inherent internal pressure ratio of the supercharger is invariable. Accordingly, when the pressure downstream of the supercharger 10, namely, the supercharging pressure, varies, there arise unavoidably in the supercharger of the prior art two problems, namely, a problem in that compression loss increases thus entailing an increase in the power consumption rate, and a problem in that the pulsative flow of air due to a the sharp pressure variation of the discharged air attributable to pressure difference between the inside and outside of the discharge port increases the noise of the supercharger 10.

SUMMARY OF THE INVENTION

Accordingly, it is a first object of the present invention to provide a mechanically driven screw supercharger eliminating the former problem in the conventional screw supercharger.

It is a second object of the present invention to provide a mechanically driven screw supercharger eliminating the latter problem in the conventional screw supercharger.

To solve the former problem in the supercharger of the prior art, the present invention provides a screw supercharger having a set of male and female screw rotors rotatably supported in a casing and driven through a wrapping transmission means including belts and pulleys by a prime mover, characterized in that a through hole is formed in the wall of the casing at a position through which the input shaft of the screw rotor or the extension of the axis of the input shaft of the screw rotor extends, in that a cylindrical bearing supporting part is formed around the through hole so as to project outside from the casing, and in that a driven pulley is supported through bearings on the bearing supporting part and is fixedly mounted on the input shaft.

To solve the latter problem in the supercharger of the prior art, the present invention provides a screw supercharger having, in addition to a main discharge port directly communicating with the suction passage of the engine, at least one auxiliary discharge port provided on the side of the suction port at an appropriate distance from the main discharge port, and a bypass passage connecting the auxiliary discharge port to the suction passage at a position downstream of the main discharge port through a switching valve capable of discharging air into the atmosphere.

BRIEF DESCRIPTION OF THE DRAWINGS

The above and other objects, features and advantages of the present invention will become fully apparent from the following description taken in conjunction with the accompanying drawings, in which.

DESCRIPTION OF THE PREFERRED EMBODIMENTS

Figure 1:
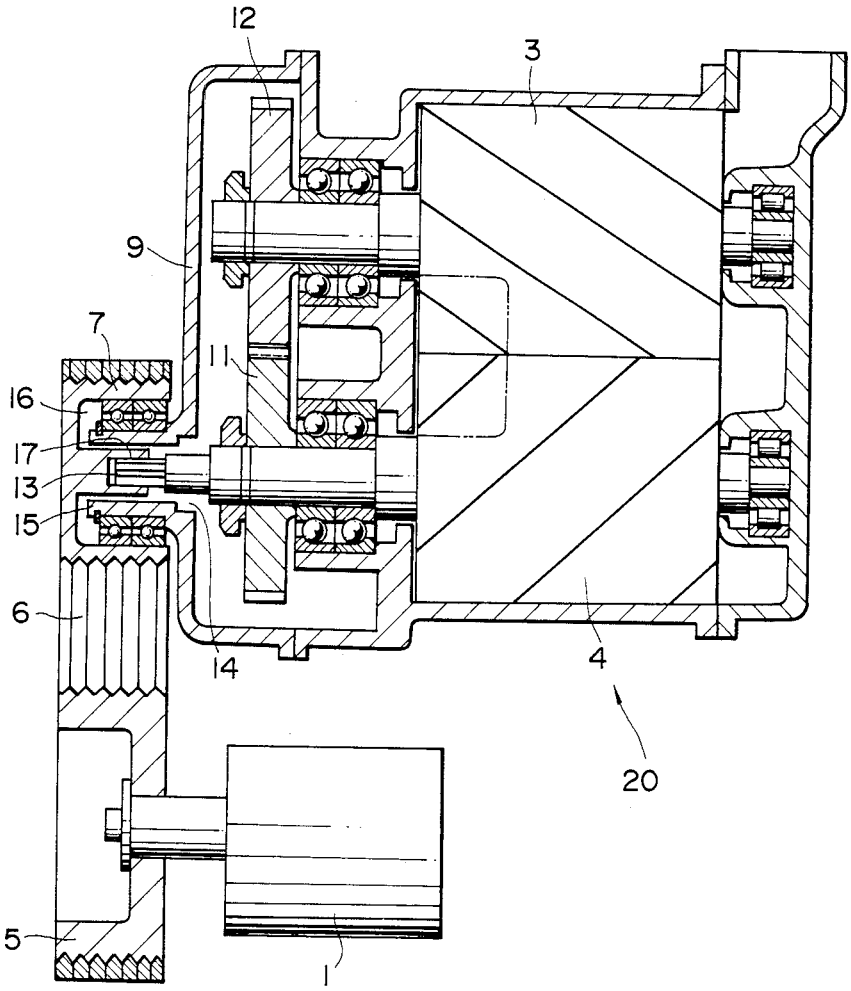
FIG. 1 is a longitudinal sectional view of a mechanically driven screw supercharger, in a first embodiment, according to the present invention.
Figure 7:
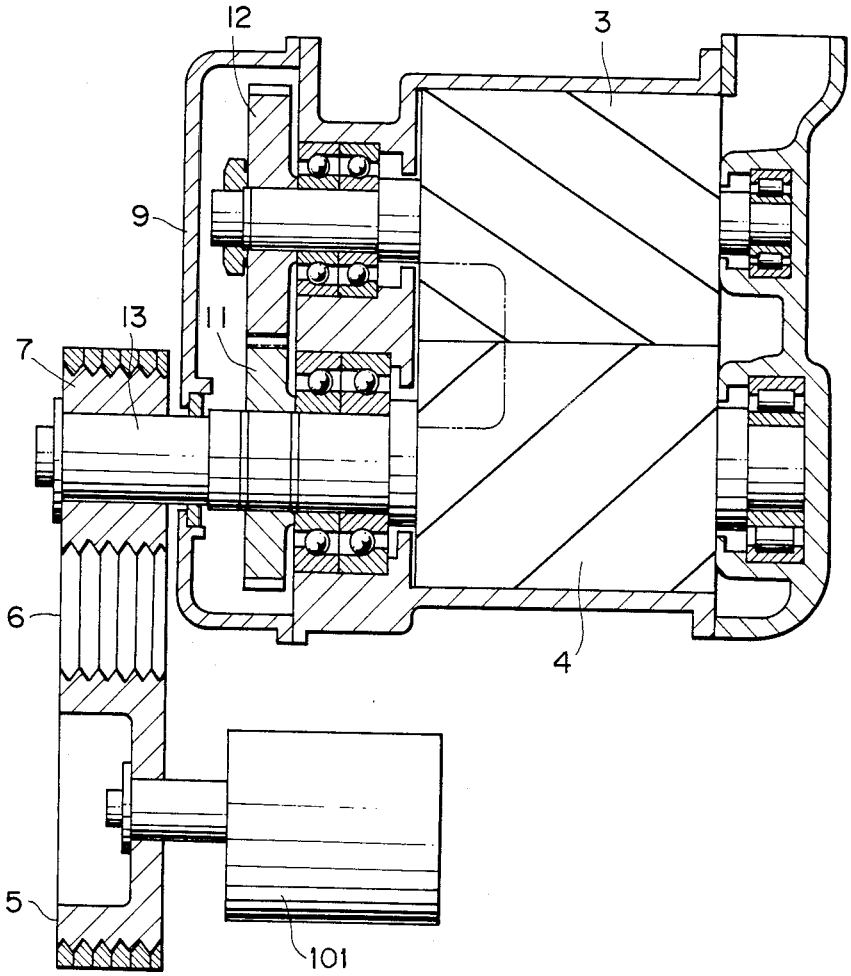
FIGURE 7 PRIOR ART
FIG. 7 is a longitudinal sectional view of a conventional engine-driven screw compressor applicable to an internal-combustion engine as a mechanically driven screw supercharger.

In a first embodiment of the present invention, a mechanically driven screw supercharger (hereinafter referred to simply as "screw supercharger") 20 of the present invention shown in FIG. 1 is substantially the same in construction as the conventional screw supercharger shown in FIG. 7, except in the construction of the power transmission system. In FIGS. 1 and 7 corresponding parts are denoted by the same reference numerals, and the description thereof will be omitted.

Referring to FIG. 1, a through hole 14 is formed in the wall of the casing 9, and a bearing supporting boss 15 is formed around the through hole 14 so as to project outside from the wall of the casing 9. The input shaft 13 (namely, the shaft of the female screw rotor 4) projects outside the casing 9 through the through hole 14 and the bearing supporting boss 15. The driven pulley 7 is supported on bearings 16 mounted on the bearing supporting boss 15. The driven pulley 7 is provided integrally with a central boss 17 projecting toward the casing 9. The extremity of the input shaft 13 is splined to the central boss 17 of the driven pulley 7.

In this embodiment, the screw supercharger 20 is driven through a power transmission system including belts and pulleys, but the present invention is not limited thereto, and the screw supercharger 20 may be driven through any other suitable wrapping power transmission system.

The through hole 14 need not necessarily be formed so as to receive the input shaft 13 therethrough, but may be formed at a position on the extension of the axis of the input shaft 13.

In the screw supercharger 20 thus constructed, the input shaft 13 is not exposed to a bending moment of the tension applied to the belts 6. Therefore, the input shaft 13 (namely, the shaft of the female screw rotor 4), need not have an increased diameter in order to withstand the bending moment, and hence the bearings 16 may be of a smaller capacity as compared with those of the conventional screw supercharger. Accordingly, the screw supercharger 20 can be formed so as to be of smaller weight and able to operate at a higher speed as compared with the equivalent conventional screw supercharger as shown in FIG. 7. Furthermore, employment of smaller bearings improves the adiabatic efficiency through the reduction of power loss. When the screw supcharger 20 is applied to an automobile, where the pressure ratio is in the range of 1.2 to 3.0, the reduction of power loss owing to the reduction in size of the bearings and the reduction in weight of the screw supercharger improves the fuel economy of the automobile.

Furthermore, since the bending, moment of the tension applied to the belts is not applied to the rotor shaft, the rotor shaft is not bent, and hence the setting of the synchronizing gears is not spoiled.

Figure 2:
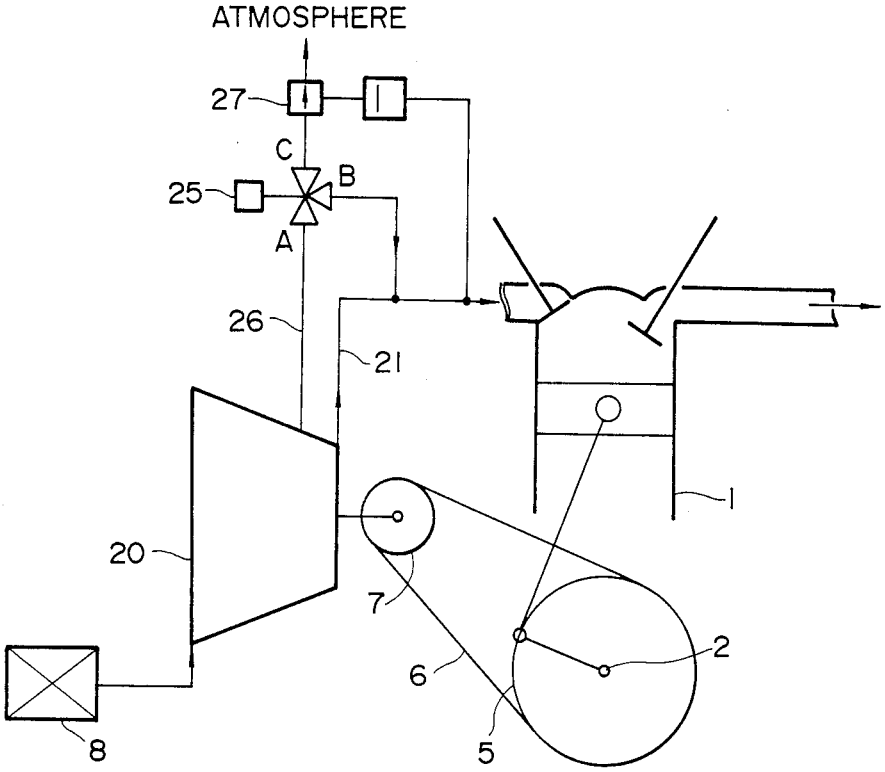
FIG. 2 is a diagrammatic illustration of the mixture feed system of an internal-combustion engine equipped with the mechanically driven screw supercharger of FIG. 1.
Figure 3:
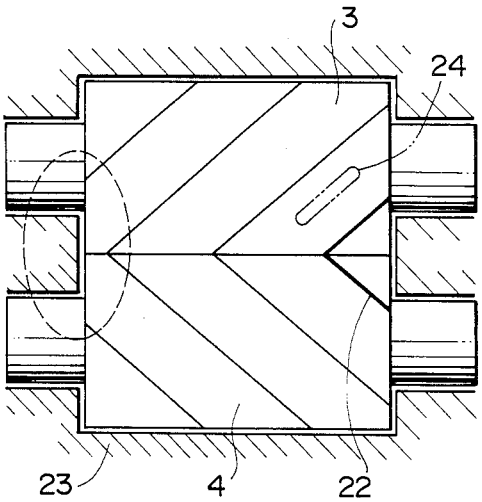
FIG. 3 is a fragmentary sectional view of assistance in explaining an auxiliary discharge port formed in the mechanically driven screw supercharger of FIG. 1 included in the mixture feed system of Fig. 2.

In a second embodiment, a screw supercharger 20 according to the present invention is substantially the same in construction as the screw supercharger 20 in the first embodiment, except that the screw supercharger 20 in the second embodiment is provided, in addition to a main discharge port 22 (see FIG. 3) directly connected to a suction passage 21 (see FIG. 2), with an auxiliary discharge port 24 formed in the casing 23 surrounding the screw rotors 3, 4 at the suitable distance from the main discharge port 22 as shown in FIG. 3, and hence parts corresponding to those previously described with reference to FIG. 1 are denoted by the same reference numerals and the description thereof will be omitted.

An arrangement of the mixture feed system including the screw supercharger in the second embodiment will be described hereinafter with reference to FIGS. 2 and 3.

The auxiliary discharge port 24 is connected to a bypass passage 26 connected through a three-way switching valve 25 to the suction passage 21 at a position downstream of the main discharge port 22. The three-way switching valve 25 has a port A connected to the auxiliary discharge port 24, a port B connected to the suction passage 21, and a port C communicating through a relief valve 27 with the atmosphere. One of the ports of the pilot valve unit of the relief valve 27 is connected to the port C, and the other port of the pilot valve unit is connected to the suction passage 21 at a position downstream of the main discharge port 22. The relief valve 27 opens when the pressure in the suction passage 21 downstream of the main discharge port 22 becomes higher than the pressure at the port C.

After the engine 1 has been started, a suitable control means determines whether the engine 1 is in a high-load operating mode requiring increased air supply on the basis of signals representing the degree of movement of the accelerator pedal, the engine speed, the internal pressure of the engine, and the fuel supply rate.

When the engine 1 is in the high-load operating mode, determination is made as to whether the engine 1 is operating in a high-speed operating mode. When the engine 1 is operating in a low-speed operating mode, the three-way switching valve 25 is operated to make the port A communicate with the port B to discharge air through the auxiliary discharge port 24 to reduce the internal pressure ratio, for example, to 1.5. When the engine 1 is operating in the high-speed operating mode, the three-way switching valve 25 is operated to disconnect the port A from both the ports B and C so that the internal pressure ratio is raised, for example, to 2.0. Thus, in the high-load and low-speed operating mode, air compressed at a low internal pressure ratio, for example, 1.5, is discharged into the engine 1 and, in the high-load and high-speed operating mode, air compressed at a high internal pressure ratio, for example, 2.0, to deal with an increase in the resistance to the flow of suction air attributable to increase in the engine speed. Although the internal pressure ratio is varied according to the engine speed, the quantity of air discharged for every combustion cycle by the screw supercharger 20 remains constant regardless of the engine speed.

In a low-load or moderate-load operating mode where the air demand per unit time is small, the port A is connected to the port C and, when the discharge rate of the screw supercharger is excessively greater than the air demand per unit time and the pressure in the suction passage downstream of the main discharge port 22 is higher than the pressure at the port C (namely, the pressure at the auxiliary discharge port 24), the relief valve 27 opens to discharge air into the atmosphere.

Figure 4:
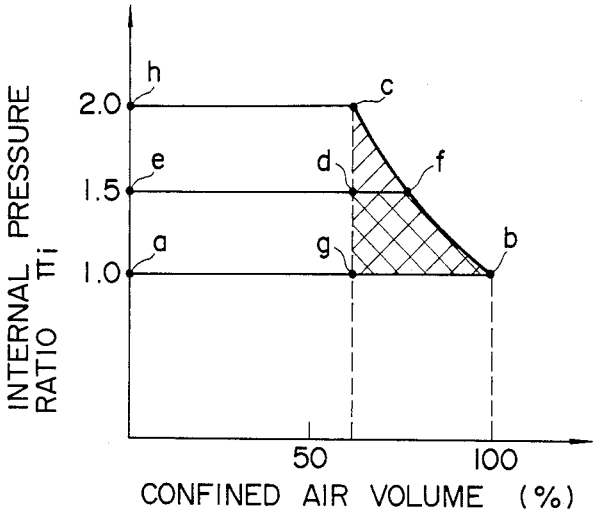
FIG. 4 is a graph showing the relation between internal pressure ratio and confined air volume in a supercharger.

The variation of the required power of the screw supercharger resulting from the change of the internal pressure ratio of the screw supercharger according to the operating mode of the engine (for example, the reduction of the internal pressure ratio from 2.0 to 1.5 for the high-load and low-speed operating mode of the engine), will be described with reference to FIG. 4.

When the port A is disconnected from the port B to stop the discharge of air from the auxiliary discharge port 24 in the high-load and low-speed operating mode, the state of the air confinement space within the screw supercharger 20 varies along a path a→b→f→c→d→e→a. The required power per cycle is represented by an area a-b-f-c-d-e.

When the port A is connected to the port B to allow the discharge of air from the auxiliary discharge port 24 in the same operating mode of the engine, the state varies along a path a→b→f→d→e→a. In this case, the required power per cycle is represented by an area a-b-f-d-e.

Since the power represented by an area a-g-d-e is recovered by the engine in either case, a net required power per cycle is represented by an area g-b-c when the internal pressure ratio is 2.0. However, the net required power per cycle is reduced at least a decrement represented by an area d-f-c when the internal pressure ratio is reduced to 1.5. Theoretically, this decrement is as large as 22% of the required power per cycle when the internal pressure ratio is 2.0.

Figure 5:
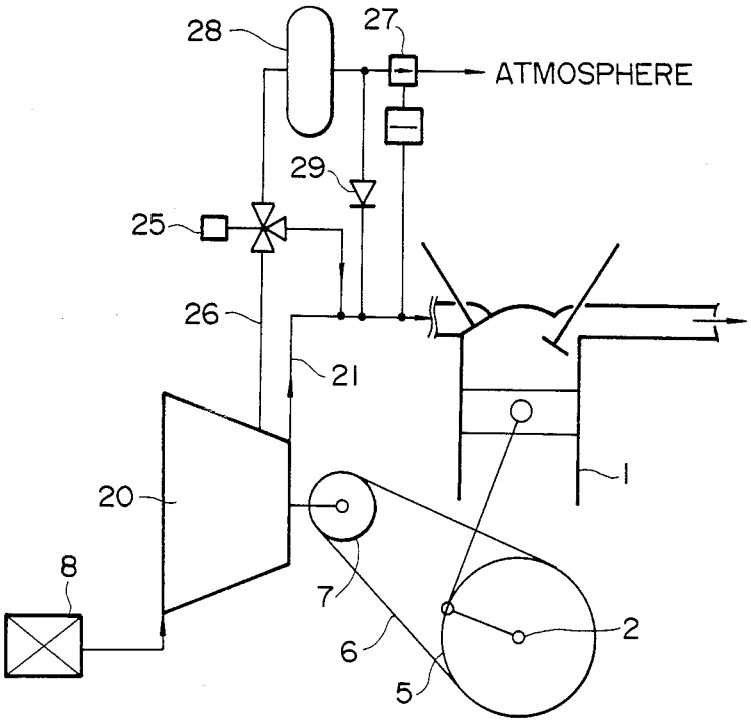
FIG. 5 is a diagrammatic illustration of the mixture feed system of an internal-combustion engine equipped with a mechanically driven screw supercharger, in a second embodiment, according to the present invention.
Figure 6:
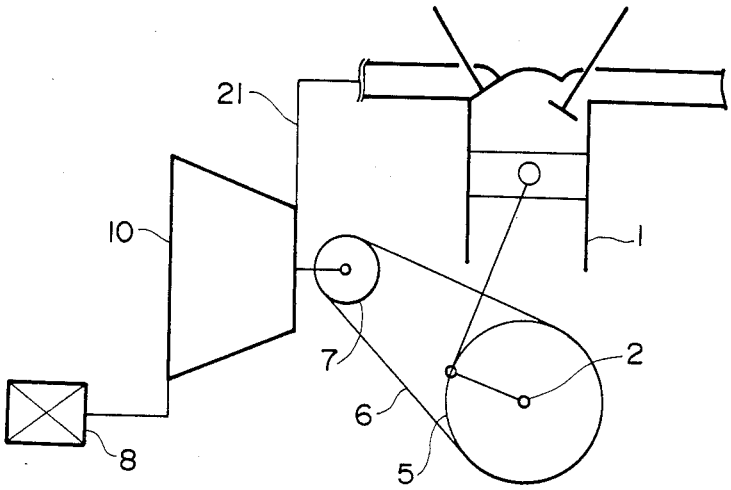
FIGURE 6 PRIOR ART
FIG. 6 is a diagrammatic illustration of the mixture feed system of an internal-combustion engine equipped with a conventional mechanically driven screw supercharger.
Figure 8:
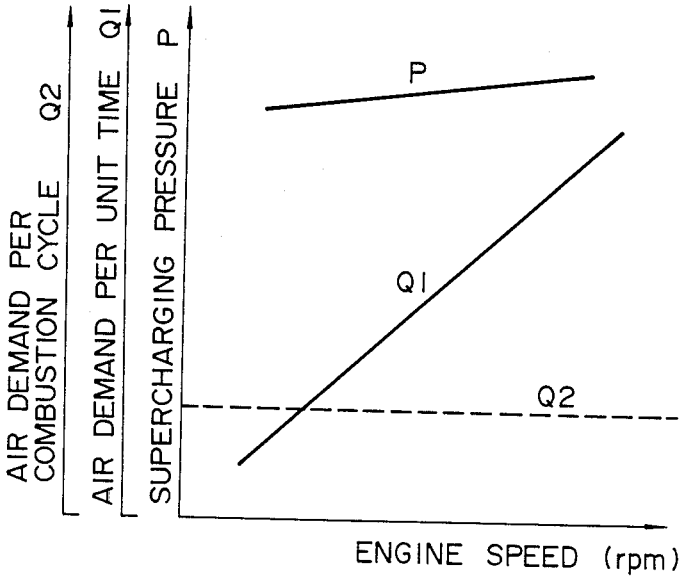
FIG. 8 is a graph showing the variation of supercharging pressure, air demand per unit time, and air demand per one combustion cycle of an internal-combustion engine with engine speed.

Another arrangement of the mixture feed system including the screw supercharger 20 of the present invention will be described hereinafter with reference to FIG. 5. The arrangement of the mixture feed system shown in FIG. 5 is substantially the same as that shown in Fig. 2, except that the arrangement of the mixture feed system of FIG. 5 is provided additionally with a tank 28 and a check valve 29. Therefore, parts corresponding to those previously described with reference to Fig. 2 are denoted by the same reference numerals, and the description thereof will be omitted.

Referring to FIG. 5, air discharged from the auxiliary discharge port 24 is accumulated temporarily in the tank 28 without discharging directly into the atmosphere through the port C. The air accumulated in the tank 28 is used for supercharging the engine 1 in starting the engine 1 and during the high-load and low-speed operating mode. When the tank 28 is filled with air to its full capacity, the excessive air is discharged through the relief valve 27.

As is apparent from the foregoing description, according to the present invention, the screw supercharger is provided, in addition to the main discharge port, with at least one auxiliary discharge port formed at a distance toward the suction side from the main discharge port, and the auxiliary discharge port is connected through a switching valve capable of connecting the auxiliary discharge port to the atmosphere by a bypass passage to the suction passage at a position downstream of the main discharge port. Accordingly, the internal pressure ratio of the screw supercharger can be regulated according to load on the engine and engine speed to reduce the power consumption of the screw supercharger by eliminating the unnecessary air compressing operation of the screw supercharger, and to reduce the noise of the screw supercharger by reducing the pressure difference between the suction passage, and the main discharge port and auxiliary discharge port of the screw supercharger.

Although the invention has been described in its preferred form with a certain degree of particularity, many changes and variations are possible therein. It is therefore to be understood that the present invention may be practiced otherwise than specifically described herein without departing from the scope and spirit thereof.

What is claimed is:

1. A mechanically driven screw supercharger comprising:

(a) a casing and (b) a set of meshing male and female screw rotors rotatably supported in said casing;

wherein:

(c) said set of meshing male and female screw rotors has an input shaft;

(d) said casing has a through hole formed in a wall thereof at a position corresponding to said input shaft or on the extension of the axis of said input shaft.

(e) a bearing supporting boss is formed around said through hole so as to project outwardly from said casing;

(f) a bearing is mounted on the external surface of said bearing supporting boss;

(g) a driven power transmitting member is journaled on said bearing;

(h) said driven power transmitting member is adapted to be driven by a prime mover and having a central boss projecting into said bearing supporting boss;

(i) said input shaft is coupled to said central boss of said driven power transmitting member;

(j) said casing has a main discharge port in fluid communication with a suction passage and an auxiliary discharge port upstream from said main discharge port; and (k) said auxiliary discharge port is connected to a three-way switching valve, one outlet port of which is connected to said suction passage downstream of said main discharge port and one outlet port of which is connected to a relief valve.

2. A mechanically driven screw supercharger as recited in claim 1 wherein said driven power transmitting member is a pulley.

3. A mechanically driven screw supercharger as recited in claim 1 and further comprising an accumulator tank positioned downstream of said three-way switching valve and upstream of said relief valve.

* * * * *